US006607400B1

(12) United States Patent
Ko

(10) Patent No.: US 6,607,400 B1
(45) Date of Patent: Aug. 19, 2003

(54) LOW PROFILE RF CONNECTOR ASSEMBLY

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/278,459

(22) Filed: Oct. 22, 2002

(51) Int. Cl.[7] ..... H01R 13/00
(52) U.S. Cl. ..... 439/581; 439/578
(58) Field of Search ..... 439/518–585, 439/63

(56) References Cited

U.S. PATENT DOCUMENTS 5,061,206 A 10/1991 Kawanami et al.
5,180,315 A 1/1993 Nagashima
5,190,474 A 3/1993 Ginet
5,322,453 A 6/1994 Resnick et al.
5,772,470 A 6/1998 Togashi
6,065,976 A * 5/2000 Wang ..... 439/63
6,106,304 A * 8/2000 Huang ..... 439/63
6,386,888 B1 * 5/2002 Skopic et al. ..... 439/63

* cited by examiner

*Primary Examiner*—Hien Vu
(74) *Attorney, Agent, or Firm*—Wei Te Chung

(57) ABSTRACT

An electrical system includes a printed circuit board (PCB, 3), a receptacle (2) and a complementary plug (1). The PCB has a top face (31) and a cutout (32) defined therein. The receptacle includes an insulative base (21), an outer contact (22) and an inner contact (23). The outer contact has a second mating portion (25) and a pair of grounding pads (24) extending from a bottom edge of the second mating portion. The inner contact is located in the outer contact and has a center pin (231) and a signal pad (26) extending from a bottom edge of the center pin. The grounding pads and the signal pad are soldered on the top face of the PCB, and the plug and the receptacle are partly located in the cutout of the PCB.

6 Claims, 5 Drawing Sheets

LOW PROFILE RF CONNECTOR ASSEMBLY

CROSS-REFERENCE TO RELATED APPLICATION

The present application is related to commonly assigned U.S. patent applications Ser. No. 10/036,052, invented by Hsin Kuo Dai and David Tso-Chin Ko, filed on Dec. 24, 2001, now U.S. Pat. No. 6,533,610 entitled "LOW-PROFILE RF CONNECTOR ASSEMBLY", and Ser. No. 10/021,628, invented by Jerry Wu, filed on Oct. 30, 2001, now U.S. Pat. No. 6,474,995, entitled "LOW-PROPILE RF CONNECTOR AND METHOD Of MANUFACTURING THE RF CONNECTOR".

BACKGROUND OF THE INVENTION

1. Field of the Invention

The present invention relates to a radio frequency (RF) connector, and more particularly to an RF connector adapted to be mounted on a cutout of a printed circuit board (PCB) thereby reducing the overall height of the connector.

2. Description of Prior Art

It is becoming mores and more desirable to provide low profile radio frequency (RF) connectors for use in mobile electrical devices.

A conventional RF connector is disclosed in U.S. Pat. No. 5,180,315, issued to Nagashima on Jan. 19, 1993. The RF connector comprises a plug and a receptacle. Ground contacts of the receptacle are soldered to a top face of the PCB. This type of RF connector occupies a large space, which has a total height equal to a height of the plug plus a height of the receptacle.

To solve the above problem, U.S. patent application Ser. No. 10/036,052 (filed on Dec. 24, 2001), assigned to the same assignee as the present invention, proposes an RF connector assembly having a receptacle, a complementary plug and a PCB. The receptacle includes a substrate, an outer contact, a central contact and three solder pads disposed on the substrate. A through hole is defined in a middle of the PCB. The outer and central contacts are accommodated in the through hole. The solder pads are soldered to a bottom face of the PCB. The plug is electrically connected with the receptacle within the through hole. As shown in this application, the RF header connector is mounted to the PCB from under the PCB, which may be somewhat unreliable when a relatively large downward pressure is executed thereon.

Hence, an improved electrical connector is required to overcome the disadvantages of the prior arts and to meet the requirement of the modern trend.

BRIEF SUMMARY OF THE INVENTION

An object of the present invention is to provide an electrical system occupying less space.

An electrical system comprises a printed circuit board (PCB), a receptacle and a complementary plug. The plug has a first mating portion and a bifurcate contact. The PCB has a top face and a cutout defined therein. The receptacle includes an insulative base, an outer contact and an inner contact respectively fixed to the insulative base. The outer contact has a second mating portion and a pair of grounding pads extending from a bottom edge thereof. The inner contact is located in the outer contact. The inner contact has a center pin and a signal pad extending from a bottom portion thereof. The grounding pads and the signal pad are soldered to the top face of the PCB. The plug electrically connects with the receptacle by engaging the first mating portion with the outer contact of the receptacle. The bifurcate contact of the plug engages with the center pin of the inner contact of the receptacle. The plug and the receptacle are partly received in the cutout of the PCB. Thus the electrical system occupies less space.

Other objects, advantages and novel features of the invention will become more apparent from the following detailed description of the present embodiment when taken in conjunction with the accompanying drawings.

DETAILED DESCRIPTION OF THE INVENTION

Figure 1:
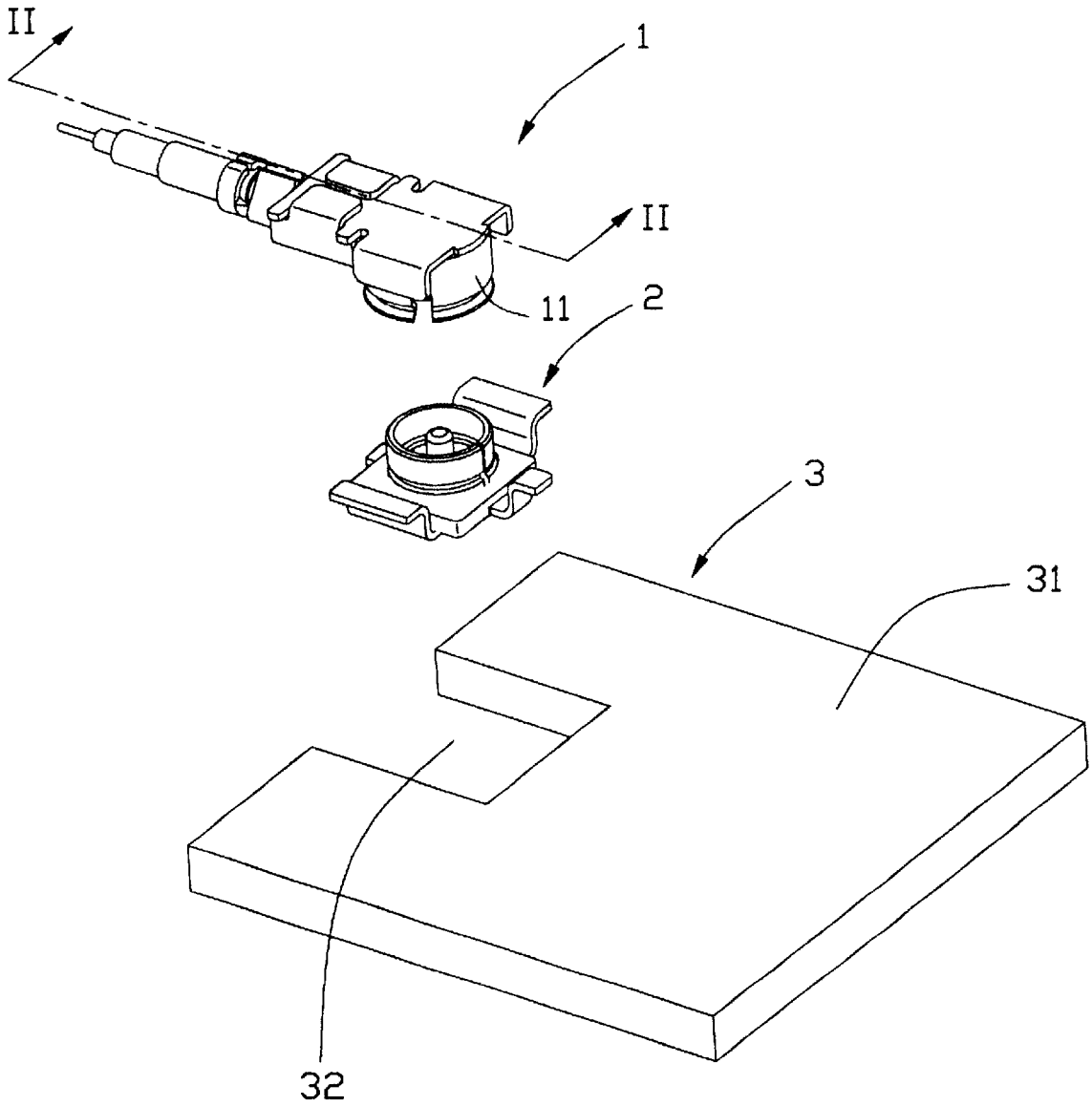
FIG. 1 is a perspective view of a radio frequency (RF) connector assembly and a printed circuit board (PCB) for the RF connector assembly to be mounted on, wherein the RF connector assembly has a receptacle and a complementary plug.

Referring to FIG. 1, an electrical system in accordance with the present invention comprises a printed circuit board (PCB) 3, a receptacle 2 and a complementary plug 1. The PCB 3 has a top face 31 and a cutout 32 defined therein.

Figure 2:
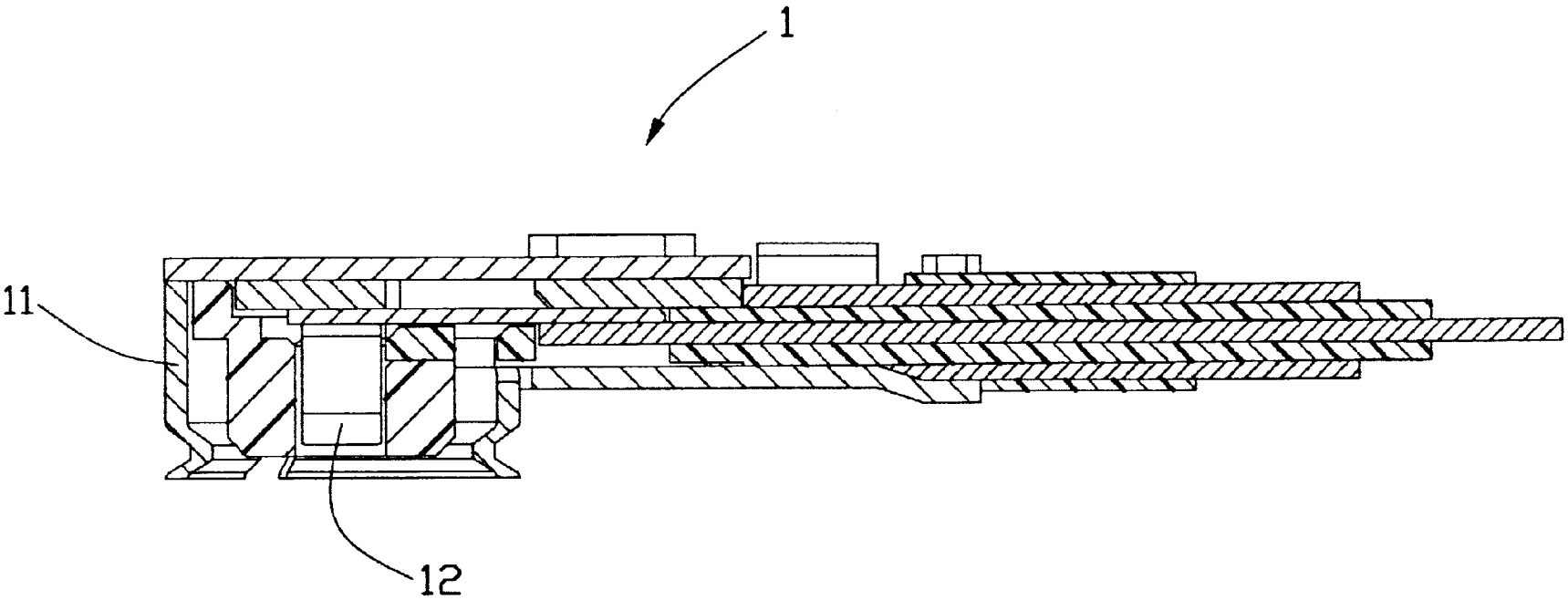
FIG. 2 is a cross-sectional view taken along line II—II of FIG. 1.

Referring to FIG. 2, the plug 1 comprises a first mating portion 11 and a bifurcate contact 12. Both the first mating portion 11 and the bifurcate contact 12 are made of conductive material.

Figure 3:
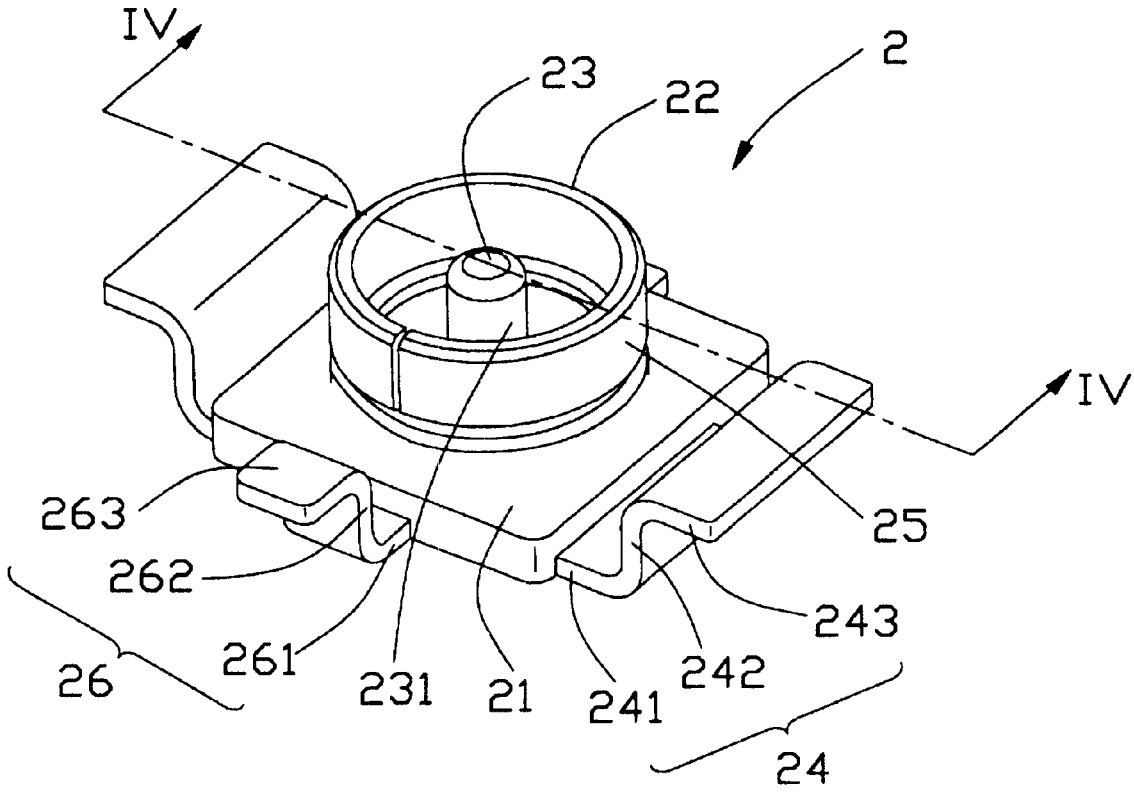
FIG. 3 is a perspective view of the receptacle shown in FIG. 1.
Figure 4:
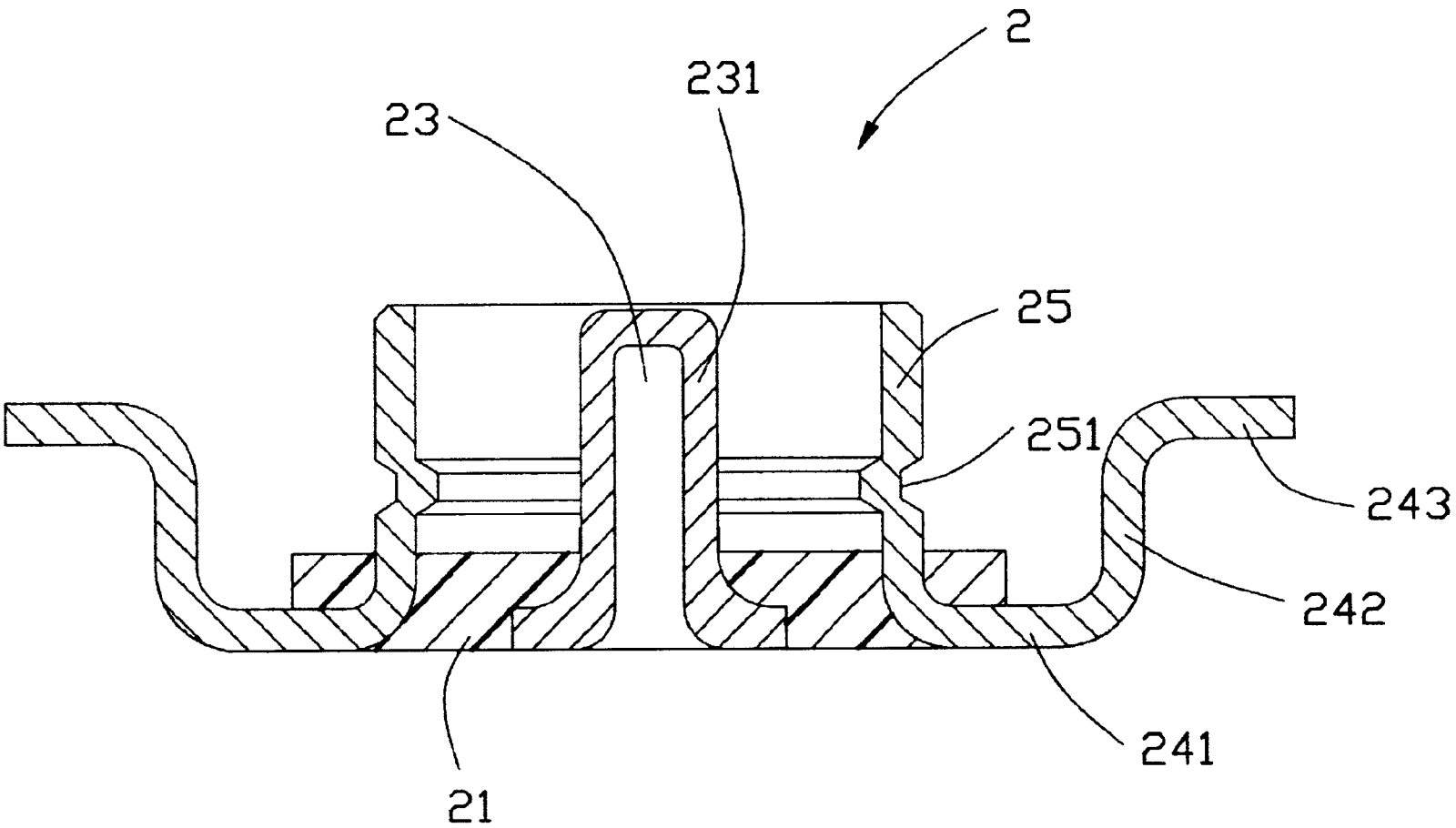
FIG. 4 is a cross-sectional view taken along line IV—IV of FIG. 3.

Referring to FIGS. 3 and 4, the receptacle 2 has an insulative base 21, an outer contact 22 and an inner contact 23 respectively insert molded with the insulative base 21. The outer contact 22 has a second mating portion 25 and a pair of grounding pads 24 symmetrically extending from a bottom edge of the second mating portion 25. The second mating portion 25 has a mating groove 251 defined adjacent to a top surface of the insulative base 21. Each grounding pad 24 has a first connecting portion 241, a first bending portion 242 extending upwardly from the first connecting portion 241 and a first soldering portion 243. The first connecting portion 241 is insert molded with the insulative base 21. The first bending portion 242 extends perpendicularly from the first connecting portion 241. The first soldering portion 243 extends from the first bending portion 242 and parallels to the first connecting portion 241. The inner contact 23 has a center pin 231 and a signal pad 26 extending from a bottom edge of the center pin 231. The signal pad 26 has a second connecting portion 261 insert molded with the insulative base 21, a second bending portion 262 extending perpendicularly and upwardly from the second connecting portion 261 and a second soldering portion 263 extending parallel to the second connecting portion 261 from the second bending portion 262.

Figure 5:
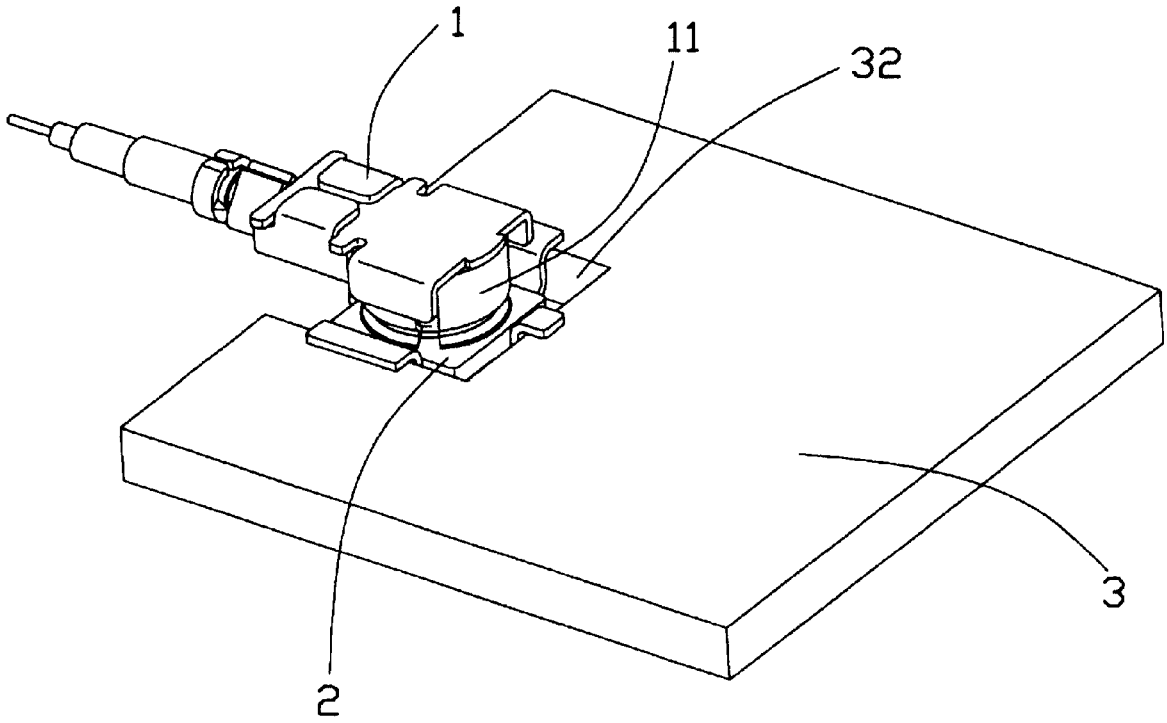
FIG. 5 is a perspective view of the RF connector assembly mounted on the PCB of the present invention.

In assembly, as shown in FIGS. 3, 4 and 5, the outer contact 25 circled the inner contact 23. The receptacle 2 is received in the cutout 32 of the PCB 3. The first soldering portions 243 of the grounding pads 24 and the second soldering portion 263 of the signal pad 26 are soldered on the top face 31 of the PCB 3. The plug 1 is inserted into the receptacle 2. The bifurcate contact 12 of the plug 1 engages with the center pin 231. of the inner contact 23 of the receptacle 2. The first mating portion 11 of the plug 1 engages with the second mating portion 25 of the outer contact 22 of the receptacle 2. The bifurcate contact 12 expands for receiving the center pin 231. Elastic force established by the bifurcate contact 12 ensures reliable electrical connection between the bifuircate contact 12 of the plug 1 and the center pin 231 of the receptacle 2. The RF connector partly received in the cutout 32 occupies less space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical system comprising:

a printed circuit board (PCB) having a top face and a cutout defined therein;

a first connector located in the cutout of the PCB and including an insulative base, an outer ground contact and an inner signal contact respectively insert molded with the insulative base, the signal contact enclosed by said ground contact, the ground contact having a mating portion and a grounding pad extending from a bottom edge of the mating portion, the signal contact located in the ground contact and having a center pin and a signal pad extending from a bottom edge of the center pin, the grounding pad and the signal pad being soldered to the top face of the PCB; and a second connector electically connecting with the ground and signal contacts of the first connector; wherein the grounding pad of the ground contact has a first connecting portion received in the insulative base, a first bending portion extending upward from the first connecting portion and a first soldering portion extending outwardly from the first bending portion and soldered to a top surface of the PCB; wherein a bottom surface of the first connecting portion of the ground contact is coplanar with a bottom surface of the insulative base; wherein the mating portion of the ground contact has a mating groove defined at a bottom portion thereof; wherein the signal pad of the signal contact has a second connecting portion received in the insulative base, a second bending portion extending upwardly from the second connecting portion and a second soldering portion extending outwardly from the second bending portion and soldered to the top surface of the PCB.

2. The connector assembly as described in claim 1, wherein a bottom surface of the second connecting portion of the signal contact is coplanar with the bottom surface of the insulative base.

3. The connector assembly as described in claim 1, wherein the mating portion is upwardly open to an exterior and extends above the top surface of the PCB.

4. The connector assembly as described in claim 1, wherein said cutout extends through the PCB in a vertical direction.

5. The connector assembly as described in claim 1, wherein said cutout extends through one edge of the PCB.

6. The connector assembly as described in claim 1, wherein both said grounding pad and said signal pad extend upwardly from the corresponding bottom edges, respectively.

* * * * *